US007246640B2

(12) United States Patent
Yang

(10) Patent No.: US 7,246,640 B2
(45) Date of Patent: Jul. 24, 2007

(54) FUEL-DISCHARGE PROTECTION SYSTEM FOR PREVENTING ELECTROSTATIC HAZARD

(76) Inventor: Hsin-Ming Yang, 3F, No. 15, Sec. 4, Hsin Long Road, Taipei (TW)

( * ) Notice: Subject to any disclaimer, the term of this patent is extended or adjusted under 35 U.S.C. 154(b) by 0 days.

(21) Appl. No.: 11/345,094

(22) Filed: Jan. 31, 2006

(65) Prior Publication Data

US 2006/0215346 A1 Sep. 28, 2006

(30) Foreign Application Priority Data

Mar. 25, 2005 (TW) ..... 94109356 A

(51) Int. Cl.
*B65B 1/04* (2006.01)

(52) U.S. Cl. ..... 141/94; 361/215; 361/212

(58) Field of Classification Search ..... 141/83, 141/94, 98; 361/212, 215–217, 220
See application file for complete search history.

(56) References Cited

U.S. PATENT DOCUMENTS 4,225,899 A * 9/1980 Sotiriou ..... 361/188
4,901,195 A * 2/1990 Stemporzewski, Jr. ..... 361/217
5,159,523 A * 10/1992 Claassen et al. ..... 361/215
6,127,934 A * 10/2000 Powell et al. ..... 340/649

FOREIGN PATENT DOCUMENTS

TW 00448414 8/2001
TW 00590216 6/2004

* cited by examiner

*Primary Examiner*—Steven O. Douglas

(57) ABSTRACT

A fuel-discharge protection system is provided herein to prevent electrostatic hazard when a tank truck is discharging fuel into a reservoir. This invention mainly contains an oil-valve switch device, a driving device, and an electrostatic detection and control device. The fuel is discharged from the tank truck into the reservoir through the oil-valve switch device. The electrostatic detection and control device monitors the ground resistance and the electrostatic voltage of the tank truck during the entire process of fuel discharge. The electrostatic detection and control device, by controlling the driving device, opens the valve of the oil-valve switch device to allow fuel discharged into the reservoir only when the ground resistance and the electrostatic voltage of the tank truck are within respective safety ranges.

11 Claims, 6 Drawing Sheets

FUEL-DISCHARGE PROTECTION SYSTEM FOR PREVENTING ELECTROSTATIC HAZARD

BACKGROUND OF THE INVENTION

1. Field of the Invention

The present invention generally relates to fuel-discharge systems and, more particularly, to a fuel-discharge protection system for preventing electrostatic hazard.

2. The Prior Arts

Grounding is often considered an extremely important issue in preventing electrostatic hazard. However, despite the technology advances, a reliable and effective grounding still seems a difficult job. Accidents due to improper grounding are still quite often, even for high-tech manufacturers.

For gas stations, electrostatics, if not treated seriously and cautiously, could cause severe property loss and human lives too. In order to avoid such accidents, relevant industries and agencies have enacted very strict regulations. For example, a petroleum company may require specifically that its franchised gas stations to have a ground resistance below 50Ω from their fuel outlets. Nevertheless, despite the strict rules and regulations, most gas stations still adopt a traditional fuel-discharge system with an un-reliable grounding as described below.

FIG. 1 is a schematic view showing how a tank truck conventionally discharges fuel into a fuel reservoir. As shown in FIG. 1, a tank truck 10 is parked besides a fuel inlet 22 of an underground fuel reservoir 20. An operator first connects the body of the tank truck 10 to a ground bar 30 buried in the ground via a conduction cable 40 to hence eliminate the static electricity carried on the truck's body. Then, the operator connects a fuel outlet 12 of the tank truck 10 to the fuel inlet 22 of the fuel reservoir 20 through a fuel pipe 50, so that fuel can flow into the fuel reservoir 20 when the operator opens the fuel outlet 12 of the tank truck 10. After fuel is discharged, the operator should close first the fuel outlet 12, dismount the fuel pipe 50, and finally disconnect the ground conduction cable 40.

In the foregoing conventional fuel-discharge system, a ground bar 30 buried underground provides inadequate grounding as the ground bar 30 would degrade gradually over time. The rust developed on the ground bar 30 would result in a greater contact resistance and even cause the ground bar 30 to be unusable. Under such a poor grounding, mounting or dismounting the fuel pipe 50 may induce sparks from static electricity to kindle the tank truck 10 or the oily gas of the fuel reservoir 20, causing a severe explosion. In real life, static electricity is not a constant substance as its name may imply, on the contrary, it could be accumulated over time to generate an instantaneous current as high as 1.5 amperes according to academic reports. Besides, the grounding quality would vary with different weather conditions. For example, the contact resistance of the ground bar 30 may meet requirements in a damp or raining day while it may not in a dry and cool day.

Therefore, for avoiding electrostatic-related accidents in gas stations, there are demands for improving the existing fuel-discharge system.

SUMMARY OF THE INVENTION

In view of the grounding problem during fuel discharge in a gas station, the primary object of this invention is to provide a fuel-discharge protection system for preventing any possible electrostatic hazard during fuel discharge from a tank truck into the reservoir of a gas station.

The fuel-discharge protection system of this invention mainly contains an oil-valve switch device, a driving device, and an electrostatic detection and control device. During a fuel discharge process, the electrostatic detection and control device continuously monitors and measures the ground resistance and the electrostatic voltage of a tank truck to provide double protections. Also, the oil-valve switch device is arranged in the discharge pipeline between the tank truck and the fuel reservoir such that the oil-valve switch device will be opened (become accessible) for fuel discharging only when both or at least one of the ground resistance and the electrostatic voltage is within a safety range. Once an unsafe ground resistance or electrostatic voltage is detected, the opened valve is automatically closed (become inaccessible) and the discharge pipeline is cut off to prevent any potential accident.

In addition to the foregoing application to fuel discharge in gas stations, this invention is also applicable to fuel discharge in the harbor or apron, or other places that would require specific cares against static electricity, such as the loading/unloading site of liquid gas or other inflammable gases, etc.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The related drawings in connection with the detailed description of this invention to be made later are described briefly as follows, wherein.

DETAILED DESCRIPTION OF THE PREFERRED EMBODIMENT

Figure 1:
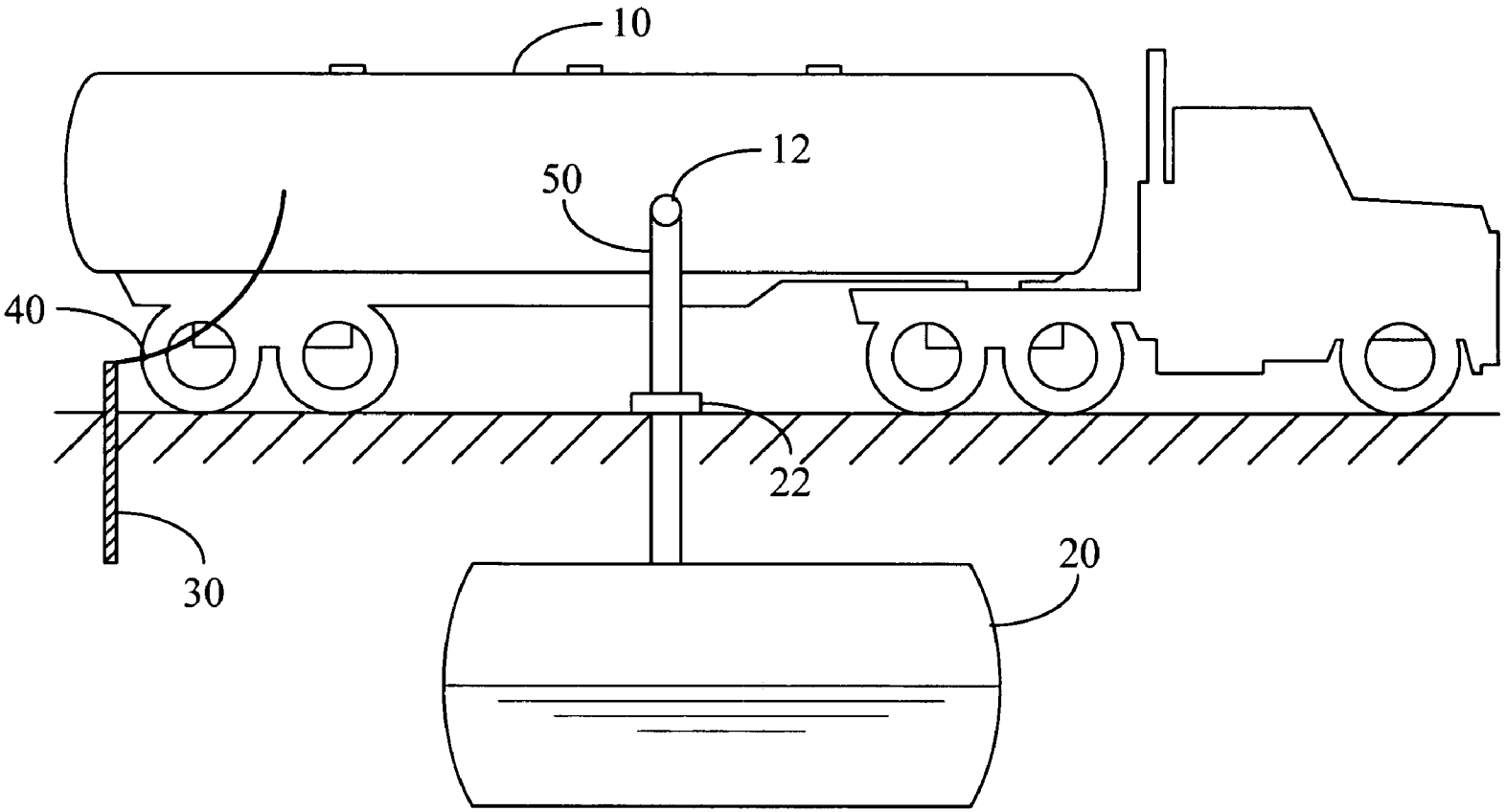
Fig. 1 (PRIOR ART)
FIG. 1 is a schematic view showing how a tank truck conventionally discharges fuel into a fuel reservoir.
Figure 2:
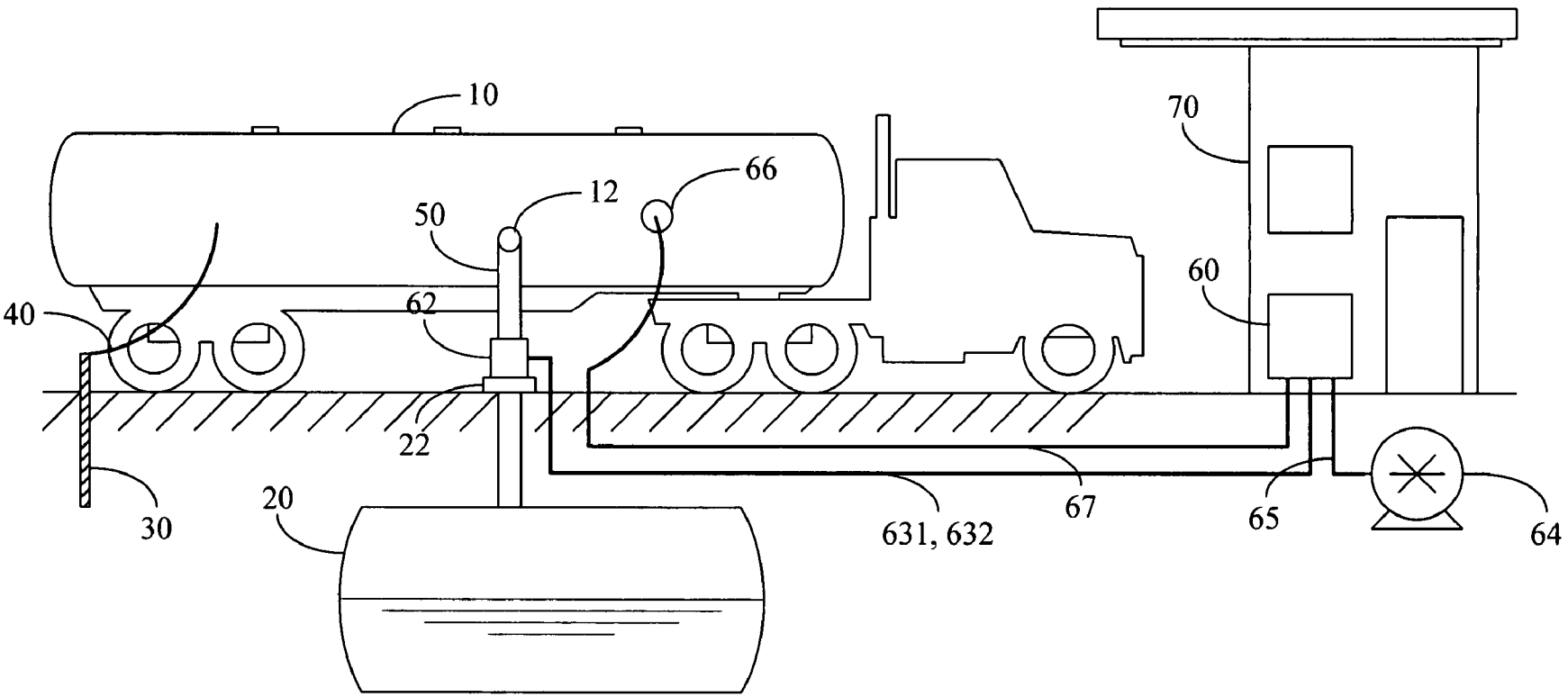
FIG. 2 is a schematic view showing an embodiment of a fuel-discharge protection system of this invention.

FIG. 2 is a schematic view showing an embodiment of a fuel-discharge protection system of this invention. As shown in FIG. 2, a fuel-discharge protection system of this invention mainly contains a pneumatic oil-valve switch device 62, an air pump 64, and an electrostatic detection and control device 60. With this invention, an operator connects the body of a tank truck 10 to a ground bar 30 through a conduction cable 40 for eliminating the static electricity carried by the truck body. Then, the operator connects a fuel outlet 12 of the tank truck 10 to the oil-valve switch device 62 through a fuel pipe 50. Please note that the oil-valve switch device 62 could be permanently coupled with a fuel inlet 22 of a fuel reservoir 20, or the oil-valve switch device 62 could be a removable apparatus and coupled to the fuel inlet 22 of the fuel reservoir 20 only during fuel discharging. The oil-valve switch device 62 is a commercially available pressure valve, and it is normally closed such that the discharge pipeline between the tank truck 10 and the fuel reservoir 20 is blocked initially. The oil-valve switch device 62 has an open inlet and a close inlet, both not shown in the accompanied diagrams. By directing air into the open or close inlets, the pressure valve of the oil-valve switch device 62 will be opened or closed by the air pressure accordingly.

The next step of the operator is to attach a sensor device 66 of the electrostatic detection and control device 60 to a grounding spot of the truck body, in which the sensor device 66 is adhered to the truck body by means of magnetism. Please note that different adhesion mechanisms could be adopted in other embodiments. The measurements taken by the sensor device 66 are transmitted to the electrostatic detection and control device 60 through a connecting cable 67. The electrostatic detection and control device 60 is usually located in an office 70 or any appropriate place of the gas station. Based on the value of ground resistance and electrostatic voltage of the tank truck 10 measured by the sensor device 66 throughout the fuel discharge process, the electrostatic detection and control device 60 decides whether to bridge the pressure pipe 65 to the pressure pipe 631 (connected to the open inlet of the oil-valve switch device 62) or the pressure pipe 632 (connected to the close inlet of the oil-valve switch device 62) so that the air pump 64 is able to pump air to open or close the pressure valve of the oil-valve switch device 62.

The operator then opens the fuel outlet 12 to allow fuel to flow into the fuel reservoir 20. From this moment on, only when the values of the ground resistance and electrostatic voltage obtained by the sensor device 66 are within the safety range, the electrostatic detection and control device 60 then would bridge the pressure pipes 631, 65 so that air from the air pump 64 can open the pressure valve and make the discharge pipeline clear. During the entire fuel discharge process, such a monitoring process is performed continuously and, therefore, no sooner have the values of ground resistance and electrostatic voltage measured by the sensor device 66 stridden over the safety range than the electrostatic detection and control device 60 bridges the pressure pipes 632, 65 to close the pressure valve of the oil-valve switch device 62 and cut off the discharge pipeline accordingly to avoid potential dangers. The fuel-discharge operation will be resumed after the dangerous condition is resolved and the values of ground resistance and electrostatic voltage obtained by the sensor device 66 return to be within the safety range.

The air pump 64 is a pump driven by electric power or a combustion engine. In FIG. 2, the pump 64 seems to be buried underground but generally it is arranged on the ground, while the pressure pipes 631, 632, 65 and the connecting cable 67 are usually buried underground beforehand in order not to interfere with the operation environment of the gas station. It should be noticed here that the oil-valve switch device 62 may or may not adopt a pressure valve. The key point of the oil-valve switch device 62 is that it is a normally closed valve, it does not use any active element to avoid an unexpected kindling of oily gas, and its valve is opened or closed by a driving device (for example, the air pump 64 in the embodiment) under control of the electrostatic detection and control device 60. Moreover, the electrostatic detection and control device 60 and the driving device (i.e., the air pump 64) may be, but not necessarily be, two independent devices. In some embodiments, they are combined into a single independent device.

Since the grounding provided by the original grounding mechanism (the ground bar 30) is to be monitored by this invention, this invention has to rely on a separate and reliable grounding. Therefore, the electrostatic detection and control device 60 uses the ground provided by the mains in the office 70 as a reference for measuring the ground resistance of the tank truck 10 after it is connected to the ground bar 30. The electrostatic detection and control device 60 mainly contains three parts, namely: a detection and power member for making sure if the ground of the mains is acceptable; a measurement member for measuring ground resistance and electrostatic voltage through the connecting cable 67; and a control member for bridging of the pressures pipes 631, 632, to the pressure pipe 65 to enable the air pump 64 to open/close the valve of the oil-valve switch device 62.

Figure 3:
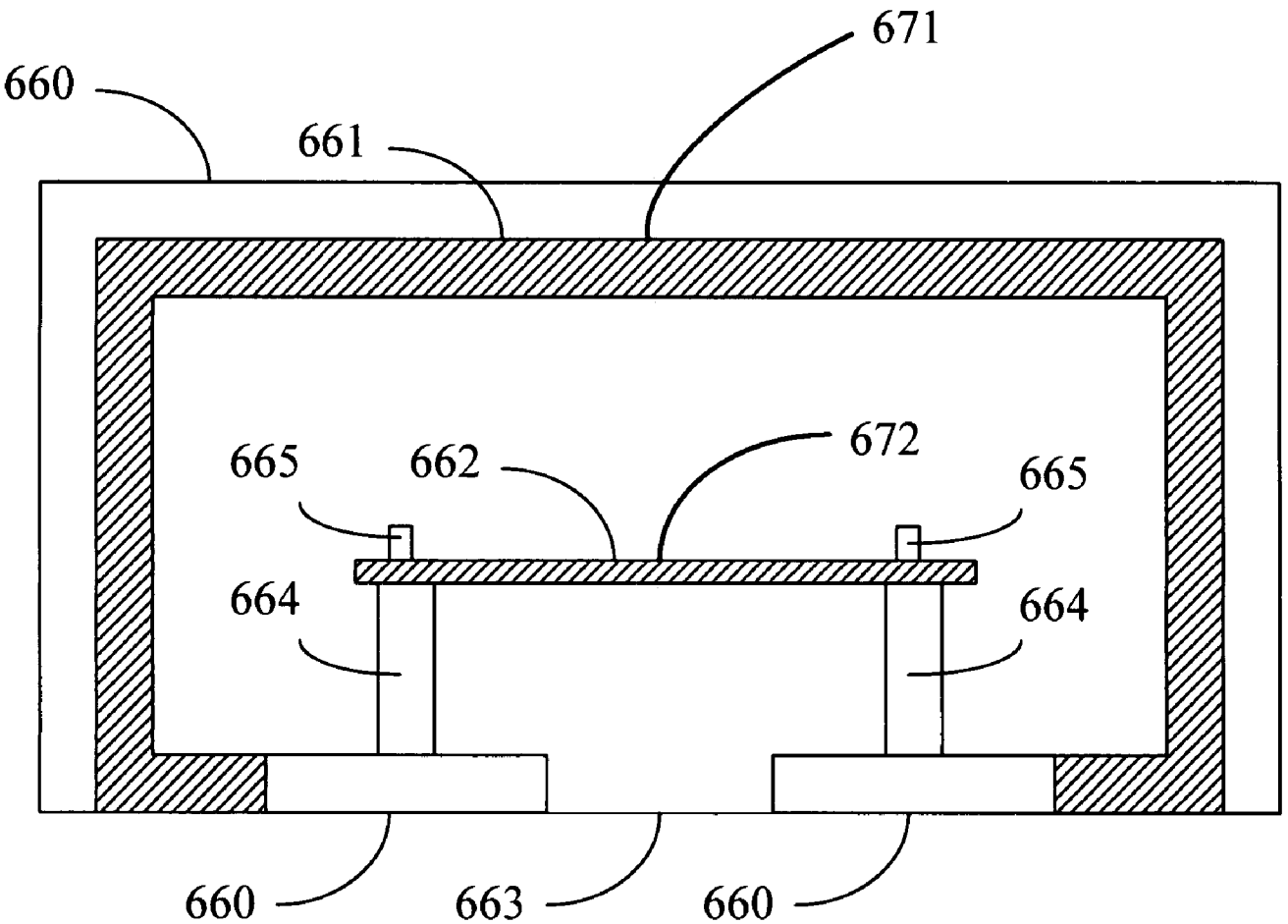
FIG. 3 is a schematic view showing a sensor device according to an embodiment of the fuel-discharge protection system of this invention.

FIG. 3 is a schematic view showing the sensor device 66, which is part of the measurement member, according to an embodiment of the fuel-discharge protection system of this invention. As illustrated in FIG. 3, the sensor device 66 is a hollow object invested by an insulating housing 660, and adhered on the inner surface of the housing 660 is an inversely disposed metallic bowl member 661, which is well matched with the housing 660 in shape and size. The rim part (no reference number) of the metallic bowl member 661 is extended outward over the housing 660 to contact the metallic body of the tank truck 10. A lead wire 671, which is a part of the connecting cable 67, is welded to the metallic bowl member 661 for the electrostatic detection and control device 60 to measure the value of ground resistance after the body of tank truck 10 is connected with the ground bar 30. Inside the housing 660 and the metallic bowl member 661, a metal piece 662 is fixed with a plurality of insulating pillars 664 and bolts 665 such that it is separated from an opening 663 of the housing 660 by a certain distance. A capacitive relationship of the metal piece 662 and the metallic body of the tank truck 10 is thereby maintained due to the existence of the opening 663. The static electricity on the body of the tank truck 10 would induce corresponding electrical charges and develop a voltage on the metal piece 662, and the voltage is measured by the electrostatic detection and control device 60 through a lead wire 672 (another part of the connecting cable 67) welded to the metal piece 662. As mentioned before, the sensor device 66 may be adhered to the truck body by means of a magnet element (not shown in FIG. 3) or other appropriate mechanisms. The magnet element must be strong enough to keep the sensor device 66 and an unpainted metallic contact surface of the tank truck 10 tightly together during the entire fuel discharge process to ensure the accurate measurement and monitoring by this invention.

Figure 4:
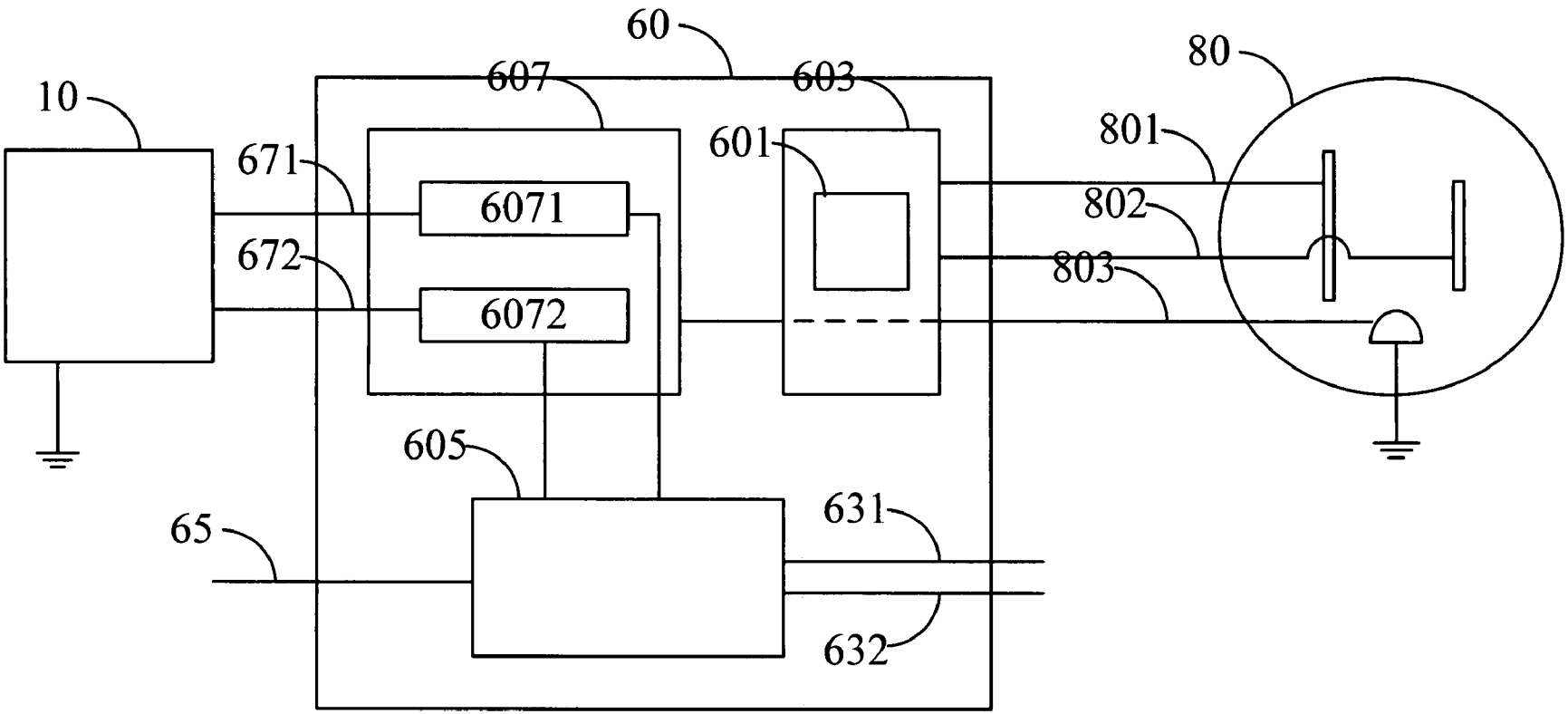
FIG. 4 is a schematic view showing the structure of an electrostatic detection and control device according to an embodiment of the fuel-discharge protection system of this invention.

FIG. 4 is a schematic view showing the structure of the electrostatic detection and control device according to an embodiment of the fuel-discharge protection system of this invention. As shown in FIG. 4, the electrostatic detection and control device 60 contains a detection and power member 603, a measurement member 607, and a control member 605. Please note that the three portions are separated mainly to simplified description hereinafter, and it is by no means to limit the dividing manner of the mentioned device. In addition, the electrostatic detection and control device 60 may further contain an operation interface consisting of on/off switches, display lights (or LCD screen), push buttons, knobs, etc., and all those elements or components are omitted here for simplicity.

Figure 5:
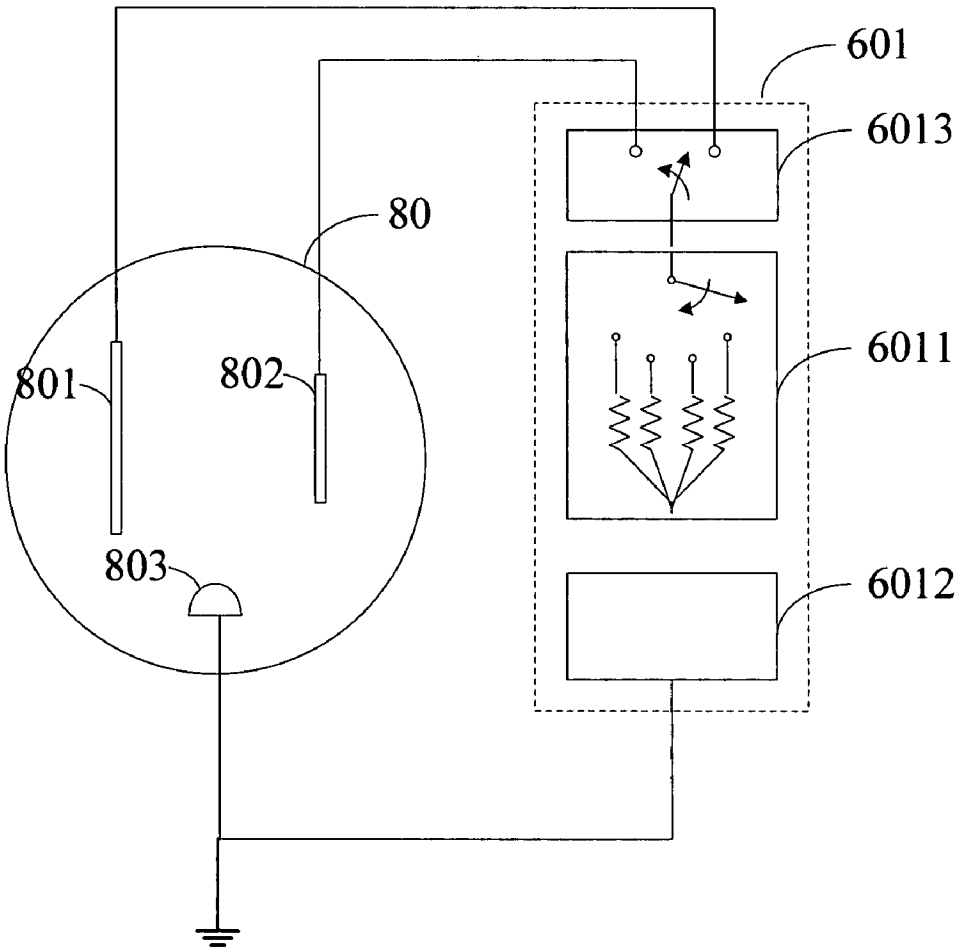
FIG. 5 is a schematic view showing the structure of a detection member of the electrostatic detection and control device according to an embodiment of the fuel-discharge protection system of this invention.

The neutral line, power line, and ground line of the mains are connected to the detection and power member 603 from a power receptacle 80 in the office 70 through respective lead wires 801, 802, 803, and after current rectification and voltage regulation, the power drawn from the mains is supplied to other modules. The detection and power member 603 further comprises a detection member 601 for detecting the mains. FIG. 5 is a schematic view showing the structure of the detection member 601 according to an embodiment of the fuel-discharge protection system of this invention. As indicated in FIG. 5, the detection member 601 mainly contains a load portion 6011, a switch 6013, and a display portion 6012. In the embodiment, the load portion 6011 contains a resistor array provided with at least four kinds of resistors with different resistances, including ∝(open circuit), 1MΩ, 5.6KΩ, and 200Ω to be selected by an additional multi-step switch (not shown), so that the grounding condition of the ground line 803 of the mains is determined according to the conduction status through different resistances, as shown in the following table:

| | Good Grounding | False Grounding | No Grounding |
|---|---|---|---|
| ∞ | Conducting | Conducting | Non-conducting |
| 1 MΩ | Conducting | Conducting | Non-conducting |
| 5.6 KΩ | Conducting | Non-conducting | Non-conducting |
| 200 Ω | Conducting | Non-conducting | Non-conducting |

The display portion 6012 may provide various types of display including, but not limited to, indicator lights, sounds, and text (such as through a LED or LCD screen). A user therefore could be informed of whether the grounding provided by the ground line 803 is acceptable or not by the display portion 6012's, for example, flashing lights and/or alarming sounds. In some embodiments of this invention, an electronic control member could be adopted and, under the control of a processor and its firmware, the resistors (not limited to the aforementioned four resistance values) of the load portion 6011 could be switched automatically and, based on the conduction conditions and the amounts of current flowing through, the display portion 6012 could report the measurement results. Please note that, in real life, it is not impossible that the power line 802 and the neutral line 801 may be inversely connected (that is, the AC voltage comes from the neutral line 801 instead of the power line 802). Therefore, the switch 6013 allows a user to select whether to take the power line 802 or the neutral line 801 as input. For example, if the power line 802 is selected as input and no conduction is detected for all resistive loads, then, the switch 6013 could be used to take the neutral line 801 as input. If again no conduction is detected for all resistive loads, then it would be very certain that there is no grounding from the ground line 803. However, if conduction is detected for all resistive loads when using the neutral line 801 as input, then the grounding provided by the ground line 803 is still acceptable despite that the power line 802 and the neutral line 801 are inversely connected.

The grounding from the ground line 803 has to be qualified by the detection member 601 before it could be used to monitor the fuel discharging process. The qualified grounding provides a reference resistance to the measurement portion 607 for comparison with the ground resistance of the tank truck 10. The measurement portion 607 contains a ground resistance measurement part 6071 and an electrostatic voltage measurement part 6072. Various embodiments of the ground resistance measurement part 6071 have already been disclosed and could be found in public publications such as Republic of China, Taiwan, Patent No. 448,414 and 590,216. In these prior arts, a common standard grounding is used as a reference to measure other unknown ground resistances. For simplicity, the details of the ground resistance measurement part 6071 are not reiterated here. Basically, any method that takes a standard ground for measuring another grounding resistance is readily applicable to the ground resistance measurement part 6071. Here, the ground resistance measurement part 6071 would determine through the lead wire 671 whether the ground resistance of the tank truck 10 is within a predetermined safety range or not, and provide the decision to the control member 605.

Similarly, the electrostatic voltage measurement part 6072 would determine through the lead wire 672 whether the electrostatic voltage of the tank truck 10 is within a predetermined safety range or not, and provide the decision to the control member 605. Basically, the electrostatic voltage measurement part 6072 can do its job easily just by connecting the lead wire 672 to an input terminal of a differential amplifier, and connecting a pre-determined reference voltage to the other input terminal of the differential amplifier, and connecting the only output terminal of the differential amplifier to the control member 605.

The control member 605 is configured to operate according one of the following three modes: (1) to open the valve of the oil-valve switch device 62 only when the ground resistance value of the tank truck 10 is within a predetermined safety range; (2) to open the valve of the oil-valve switch device 62 only when the electrostatic voltage of the tank truck 10 is within a predetermined safety range; and (3) to open the valve of the oil-valve switch device 62 only when both the ground resistance and the electrostatic voltage of the tank truck 10 are within their respective safety ranges. A user could configure the electrostatic detection and control device 60 to operate under a desired mode. Under the desired mode of operation, it is quite straightforward for the control member 605 to open the valve of the oil-valve switch device 62 by bridging the pressure pipes 631 and 65 together so that the air pumped by the air pump 64 will reach the oil-valve switch device 62 and push its pressure valve open. When an unsafe condition is detected under the desired mode of operation, the control member 605 simply switches to bridge the pressure pipes 632 and 65 so that the air pressure from the air pump 64 pushes the pressure valve of the oil-valve switch device 62 to return to its normally closed position and disrupts the fuel discharging.

Figure 6:
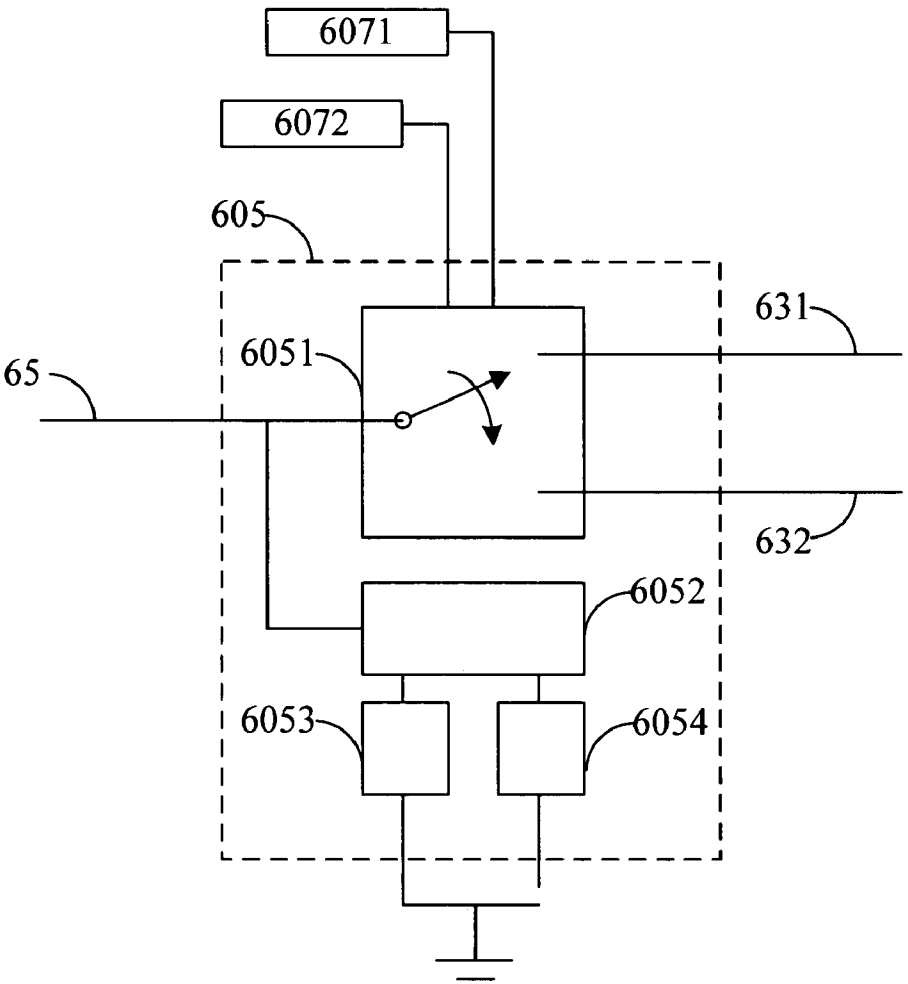
FIG. 6 is a schematic view showing the structure of a control member of the electrostatic detection and control device according to an embodiment of the fuel-discharge protection system of this invention.

FIG. 6 is a schematic view showing the structure of the control member of the electrostatic detection and control device according to an embodiment of the fuel-discharge protection system of this invention. As illustrated, the control member 605 mainly contains a switch part 6051 which, based on the configured operation mode, bridges the pressure pipe 65 with either the pressure pipe 631 (to open the oil-valve switch device 62) or the pressure pipe 632 (to close the oil-valve switch device 62). To make sure that the air pump 64 is functional and there is air pumped from the pressure pipe 65, a monitor and alarming mechanism is configured as follows. The pressure pipe 65 is branched to a microswitch 6052 which in turn connects to a green-light indicator 6053 and a red-light indicator 6054. When there is air pumped from the pressure pipe 65, the air would set the microswitch 6052 into a configuration that turns on the green-light indicator 6053 and off the red-light indicator

6054. On the other hand, when there is no air from the pressure pipe 65, the microswitch 6052 would automatically reset itself to another configuration that turns on the red-light indicator 6054 and off the green-light indicator 6053. As such, a user could learn the operating condition of the air pump 64 and, if the air pump 64 fails for some reason, the user is able to fix it and makes sure that the safety mechanism provided by the present invention is available when potential electrostatic hazard indeed occurs. It should be obvious that there are various other ways to monitor the air pump and the foregoing approach is only one of the many possible solutions.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A fuel-discharge protection system for detecting an electrostatic voltage and a ground resistance of a tank truck when said tank truck is discharging fuel into a fuel reservoir, said fuel-discharge protection system comprising:

an oil-valve switch device positioned in a discharge pipeline between said tank truck and said fuel reservoir, said oil-valve switch device having a valve to open or close said discharge pipeline;

an electrostatic detection and control device connected to a metallic portion of said tank truck through a first connecting cable for continuously measuring said electrostatic voltage and said ground resistance of said tank truck; and a driving device for opening and closing said valve of said oil-valve switch device through a second connecting cable;

wherein, based on a configured operation mode, said electrostatic detection and control device controls said driving device to open said valve of said oil-valve switch device only when at least one of said electrostatic voltage and said ground resistance of said tank truck measured through said first connecting cable is within a pre-determined safety range; and said electrostatic detection and control device controls said driving device to close said valve of said oil-valve switch device when at least one of said electrostatic voltage and said ground resistance of said tank truck measured through said first connecting cable is not within said predetermined safety range.

2. The fuel-discharge protection system according to claim 1, wherein said configured operation mode is selected from one of the following modes: said ground resistance of said tank truck must be within a pre-determined safety range of ground resistance; said electrostatic voltage of said tank truck must be within a pre-determined safety range of electrostatic voltage; and both said ground resistance and said electrostatic voltage of said tank truck must be within the safety ranges of ground resistance and electrostatic voltage respectively.

3. The fuel-discharge protection system according to claim 1, wherein said electrostatic detection and control device comprises a sensor device at an end of said first connecting cable directly attached to said metallic part of said tank truck so that said electrostatic detection and control device continuously measures said electrostatic voltage and said ground resistance of said tank truck through said first connecting cable.

4. The fuel-discharge protection system according to claim 3, wherein said sensor device comprises a first metallic member and a second metallic member; said first metallic member directly contacts said metallic part of said tank truck and connects to a first lead wire of said first connecting cable so as to deliver measured result to said electrostatic detection and control device; said second metallic member is located inside said first metallic member and separated from said metallic part of said tank truck by an appropriate distance for sensing said electrostatic voltage of said tank truck through an opening of said first metallic member; and said second metallic member is connected to a second lead wire of said first connecting cable so as to deliver measured result to said electrostatic detection and control device.

5. The fuel-discharge protection system according to claim 1, wherein said electrostatic detection and control device comprises:

a detection and power member connected to a neutral line, a power line, and a ground line of a mains outlet, said detection and power member detecting whether said ground line of said mains outlet provides a standard ground resistance;

a measurement member connected to said first connecting cable comprising a ground resistance measurement part and an electrostatic voltage measurement part, said ground resistance measurement part using said standard ground resistance provided by said ground line as reference against said ground resistance of said tank truck read through said first connecting cable so as to make a decision whether or not said ground resistance of said tank truck is within a pre-determined safety range; said electrostatic voltage measurement part using an appropriate voltage as reference against said electrostatic voltage of said tank truck read through said first connecting cable so as to make a decision whether or not said electrostatic voltage of said tank truck is within a pre-determined safety range; and a control member receiving the decisions made by said ground resistance measurement part and said electrostatic voltage measurement part from said measurement member and directing said driving device to open and close said valve of said oil-valve switch device according to the decisions and said configured operation mode;

wherein said detection and power member supplies power to said measurement member and said control member.

6. The fuel-discharge protection system according to claim 5, wherein said detection and power member detects whether said ground line of said mains outlet provides a standard ground resistance based on conduction states of directing current to flow through a plurality of resistive loads and into said ground line.

7. The fuel-discharge protection system according to claim 5, wherein said detection and power member has a switch to select input power from one of said power line and said neutral line of said mains outlet.

8. The fuel-discharge protection system according to claim 5, wherein said detection and power member reports whether said ground line of said mains outlet provides a standard ground resistance by at least one of the following means: light signals, sounds, and text.

9. The fuel-discharge protection system according to claim 1, wherein said valve of said oil-valve switch device is a normally closed pressure valve; said driving device is an air pump to supply air pressure through said second connecting cable to open and close said valve of said oil-valve switch device under the control of said electrostatic detection and control device.

10. The fuel-discharge protection system according to claim 9, wherein said second connecting cable passes through said electrostatic detection and control device; said electrostatic detection and control device, based on said configured operation mode, directs air pressure to separate inlets of said oil-valve switch device so as to open and close said valve respectively.

11. The fuel-discharge protection system according to claim 9, wherein said electrostatic detection and control device monitors air pressure from said driving device and issues alarms when said driving device is unable to provide air pressure to open and close said valve of said oil-valve switch device.

* * * * *